US011654318B1

(12) United States Patent
Lynch

(10) Patent No.: US 11,654,318 B1
(45) Date of Patent: May 23, 2023

(54) MOBILE TRAMPOLINE BASKETBALL GAME

(71) Applicant: Amy Lynch, Pella, IA (US)

(72) Inventor: Amy Lynch, Pella, IA (US)

( * ) Notice: Subject to any disclaimer, the term of this patent is extended or adjusted under 35 U.S.C. 154(b) by 0 days.

(21) Appl. No.: 16/442,005

(22) Filed: Jun. 14, 2019

(51) Int. Cl.

| | |
|---|---|
| ***A63B 5/11*** | (2006.01) |
| ***A63B 63/08*** | (2006.01) |
| ***A63B 67/00*** | (2006.01) |
| ***A63B 71/02*** | (2006.01) |

(52) U.S. Cl.
CPC ..... *A63B 5/11* (2013.01); *A63B 63/083* (2013.01); *A63B 67/002* (2013.01); *A63B 71/022* (2013.01); *A63B 2067/005* (2013.01); *A63B 2210/50* (2013.01)

(58) Field of Classification Search
CPC ..... A63B 67/002; A63B 5/11; A63B 63/083; A63B 71/022; A63B 2067/005; A63B 2210/50
See application file for complete search history.

(56) References Cited

U.S. PATENT DOCUMENTS 3,018,102 A * 1/1962 Murphy ..... A63B 63/083 473/481
3,201,126 A * 8/1965 Nissen ..... A63B 5/11 273/393
3,414,262 A * 12/1968 Lounsbury ..... A63B 63/083 248/62
D216,684 S * 3/1970 Mifflintown ..... D34/14
3,881,724 A * 5/1975 Beveridge ..... A63B 63/083 473/472
4,286,800 A * 9/1981 Lomas ..... B60P 3/1033 280/414.1
4,934,696 A * 6/1990 Jackan ..... A63B 63/083 182/163
5,087,054 A * 2/1992 O'Neil ..... A63G 31/08 273/384
5,098,092 A * 3/1992 Aakre ..... A63B 63/083 473/483
5,098,093 A * 3/1992 Dupre ..... A63B 63/083 473/483
5,100,132 A * 3/1992 Anderson ..... A63B 63/083 473/481
5,310,176 A * 5/1994 Berg ..... A63B 63/083 473/433

(Continued)

FOREIGN PATENT DOCUMENTS

DE 20 2015 106 114 * 1/2016 ..... A63B 71/022

OTHER PUBLICATIONS

DE 202015106114—machine translation http://translationportal.epo.org/emtp/translate/?ACTION=description-retrieval&COUNTRY=DE&ENGINE=google&FORMAT=docdb&KIND=U1&LOCALE=en_EP&NUMBER=202015106114&OPS=ops.epo.org/3.2&SRCLANG=de&TRGLANG=en (Year: 2016).*

*Primary Examiner* — Melba Bumgarner
*Assistant Examiner* — Amir A Klayman
(74) *Attorney, Agent, or Firm* — Suiter Swantz pc llo

(57) ABSTRACT

A mobile trampoline basketball game device includes a collapsible top frame component with lateral support members that secure collapsible backboards in place. The lateral support members are secured in a playable configuration via lateral support posts releasably affixed to door frame posts. The lateral support members collapse down with the collapsible backboards in a transport configuration to fit within a size suitable for transport as a trailer.

9 Claims, 9 Drawing Sheets

(56) References Cited

U.S. PATENT DOCUMENTS 5,364,091 A * 11/1994 Sebek ..... A63B 69/0071 473/433
5,655,766 A * 8/1997 Klebe, Jr. ..... A63B 71/022 473/197
5,833,557 A 11/1998 Cole
5,839,733 A * 11/1998 Meeks ..... A63B 63/004 273/400
5,954,600 A * 9/1999 Gill ..... A63B 63/004 273/400
6,019,690 A * 2/2000 Parr ..... A63B 63/083 473/479
6,168,548 B1 * 1/2001 Fleming ..... A63B 3/00 482/41
D444,200 S * 6/2001 Chandler ..... D21/814
6,536,770 B1 * 3/2003 Yang ..... A63B 63/06 273/317.3
6,918,591 B2 * 7/2005 D'Amico ..... A63B 69/0071 273/317.3
6,945,885 B2 * 9/2005 Snider ..... A63B 63/008 473/477
6,988,967 B2 * 1/2006 Allison ..... A63B 5/11 473/469
7,001,291 B2 * 2/2006 Carey ..... A63B 61/02 473/479
7,832,265 B1 * 11/2010 Gong ..... A63B 67/002 73/147
8,328,695 B2 * 12/2012 Ronan ..... A63B 63/08 482/29
9,084,908 B1 * 7/2015 Chen ..... A63B 71/021
9,192,867 B1 * 11/2015 Sann ..... A63B 17/02
9,333,406 B1 * 5/2016 Weeder ..... A63B 63/083
9,452,334 B2 * 9/2016 Ko ..... A63B 63/083
9,750,999 B2 * 9/2017 Monaco ..... A63B 71/023
10,188,955 B2 * 1/2019 Gantz ..... B60P 3/025
2003/0040383 A1 * 2/2003 Squibb ..... A63B 63/083 473/481
2007/0191148 A1 * 8/2007 Shannon ..... A63B 63/083 473/476
2012/0184401 A1 * 7/2012 Shepherd ..... A63B 63/083 473/481
2013/0017911 A1 * 1/2013 Kessler ..... A63B 63/00 473/470
2017/0056738 A1 * 3/2017 Escamilla ..... A63B 71/022
2017/0128804 A1 * 5/2017 Bruce ..... A63B 63/083
2018/0280774 A1 * 10/2018 Mills ..... A63B 63/083
2019/0136906 A1 * 5/2019 Chen ..... F16C 11/04
2020/0179785 A1 * 6/2020 Cotton ..... A63B 71/023
2020/0246679 A1 * 8/2020 Oliveira ..... E04B 1/3445
2021/0316199 A1 * 10/2021 Coulter ..... A63B 69/0097

* cited by examiner

MOBILE TRAMPOLINE BASKETBALL GAME

FIELD OF THE INVENTION

Embodiments of the inventive concepts disclosed herein are directed generally toward a mobile gaming device, and more particularly toward a trailer mounted, collapsible trampoline basketball game.

BACKGROUND

Trampoline basketball games are generally stationary or require substantial breakdown for transport. Such games include many features for the safety of the users that are incompatible with easily moving the game. Furthermore, the dimensions of such games make them problematic to move intact.

SUMMARY

In one aspect, embodiments of the inventive concepts disclosed herein are directed to a mobile trampoline basketball game with a collapsible top frame component to lower the backboards for transport.

In a further aspect, the components are configured to prevent user contact with certain components that may be hazardous to the users.

It is to be understood that both the foregoing general description and the following detailed description are exemplary and explanatory only and should not restrict the scope of the claims. The accompanying drawings, which are incorporated in and constitute a part of the specification, illustrate exemplary embodiments of the inventive concepts disclosed herein and together with the general description, serve to explain the principles.

BRIEF DESCRIPTION OF THE DRAWINGS

The numerous advantages of the embodiments of the inventive concepts disclosed herein may be better understood by those skilled in the art by reference to the accompanying figures in which.

DETAILED DESCRIPTION

Figure 1:
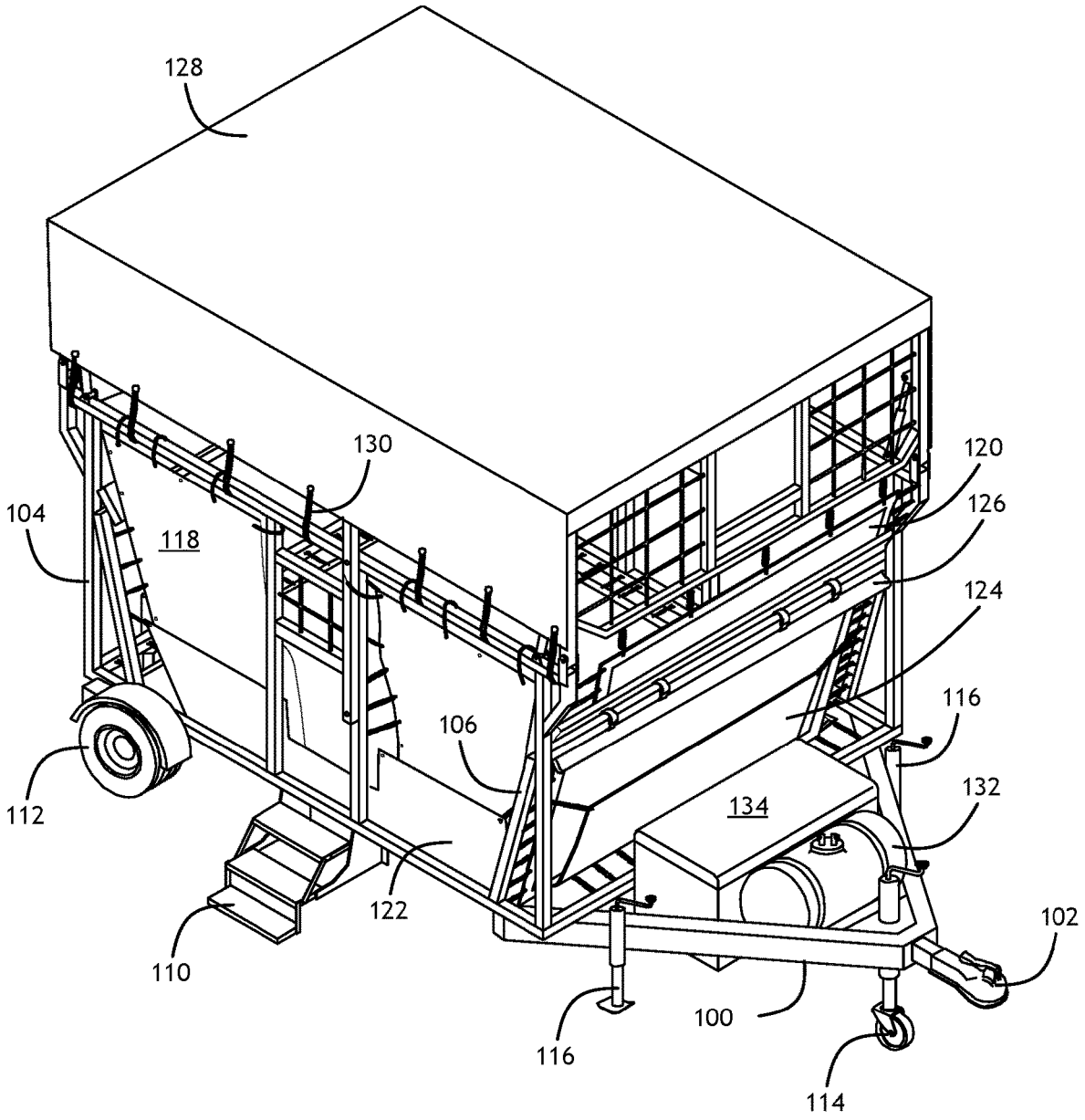
FIG. 1 shows a perspective view of an exemplary embodiment of a mobile trampoline basketball device according to the inventive concepts disclosed herein.

Before explaining at least one embodiment of the inventive concepts disclosed herein in detail, it is to be understood that the inventive concepts are not limited in their application to the details of construction and the arrangement of the components or steps or methodologies set forth in the following description or illustrated in the drawings. In the following detailed description of embodiments of the instant inventive concepts, numerous specific details are set forth in order to provide a more thorough understanding of the inventive concepts. However, it will be apparent to one of ordinary skill in the art having the benefit of the instant disclosure that the inventive concepts disclosed herein may be practiced without these specific details. In other instances, well-known features may not be described in detail to avoid unnecessarily complicating the instant disclosure. The inventive concepts disclosed herein are capable of other embodiments or of being practiced or carried out in various ways. Also, it is to be understood that the phraseology and terminology employed herein is for the purpose of description and should not be regarded as limiting.

As used herein a letter following a reference numeral is intended to reference an embodiment of the feature or element that may be similar, but not necessarily identical, to a previously described element or feature bearing the same reference numeral (e.g., 1, 1a, 1b). Such shorthand notations are used for purposes of convenience only, and should not be construed to limit the inventive concepts disclosed herein in any way unless expressly stated to the contrary.

Further, unless expressly stated to the contrary, "or" refers to an inclusive or and not to an exclusive or. For example, a condition A or B is satisfied by anyone of the following: A is true (or present) and B is false (or not present), A is false (or not present) and B is true (or present), and both A and B are true (or present).

In addition, use of the "a" or "an" are employed to describe elements and components of embodiments of the instant inventive concepts. This is done merely for convenience and to give a general sense of the inventive concepts, and "a" and "an" are intended to include one or at least one and the singular also includes the plural unless it is obvious that it is meant otherwise.

Finally, as used herein any reference to "one embodiment," or "some embodiments" means that a particular element, feature, structure, or characteristic described in connection with the embodiment is included in at least one embodiment of the inventive concepts disclosed herein. The appearances of the phrase "in some embodiments" in various places in the specification are not necessarily all referring to the same embodiment, and embodiments of the inventive concepts disclosed may include one or more of the features expressly described or inherently present herein, or any combination of sub-combination of two or more such features, along with any other features which may not necessarily be expressly described or inherently present in the instant disclosure.

Broadly, embodiments of the inventive concepts disclosed herein are directed to a mobile trampoline basketball gaming device.

Referring to FIG. 1, a perspective view of an exemplary embodiment of a mobile trampoline basketball device according to the inventive concepts disclosed herein is shown. The mobile trampoline basketball device includes a trailer frame component 100 with a trailer coupler 102. The trailer frame component 100 is affixed to a frame comprising vertical frame posts 104, angled trampoline frame components 106, a base trampoline component, and a collapsible frame component (as more fully described herein). The frame includes one or more wheeled components 112 to facilitate transport. In at least one embodiment, the frame includes a wheeled trailer jack 114 to facilitate movement of the mobile trampoline basketball device when not secured to a vehicle.

In at least one embodiment, one or more sets of collapsible stairs 110 are affixed to the frame. In at least one embodiment, one or more jacks 116 are affixed to the frame at various locations to allow the mobile trampoline basketball device to be levelled and stabilized.

The frame supports a plurality of independent trampoline components 118, 120 and a plurality of safety or environmental pads 122, 124, 126, 128.

In at least one embodiment, the mobile trampoline basketball device includes at least one storage element 134 for storing various removable components during transport, and a pressurized vessel 132 for storing a pressurized gas or pressurizing a fluid to actuate various hydraulic or pneumatic components. Such hydraulic or pneumatic components may include the one or more jacks 116 and/or certain linear actuators configured to raise collapsible back-board components as more fully described herein.

Figure 2:
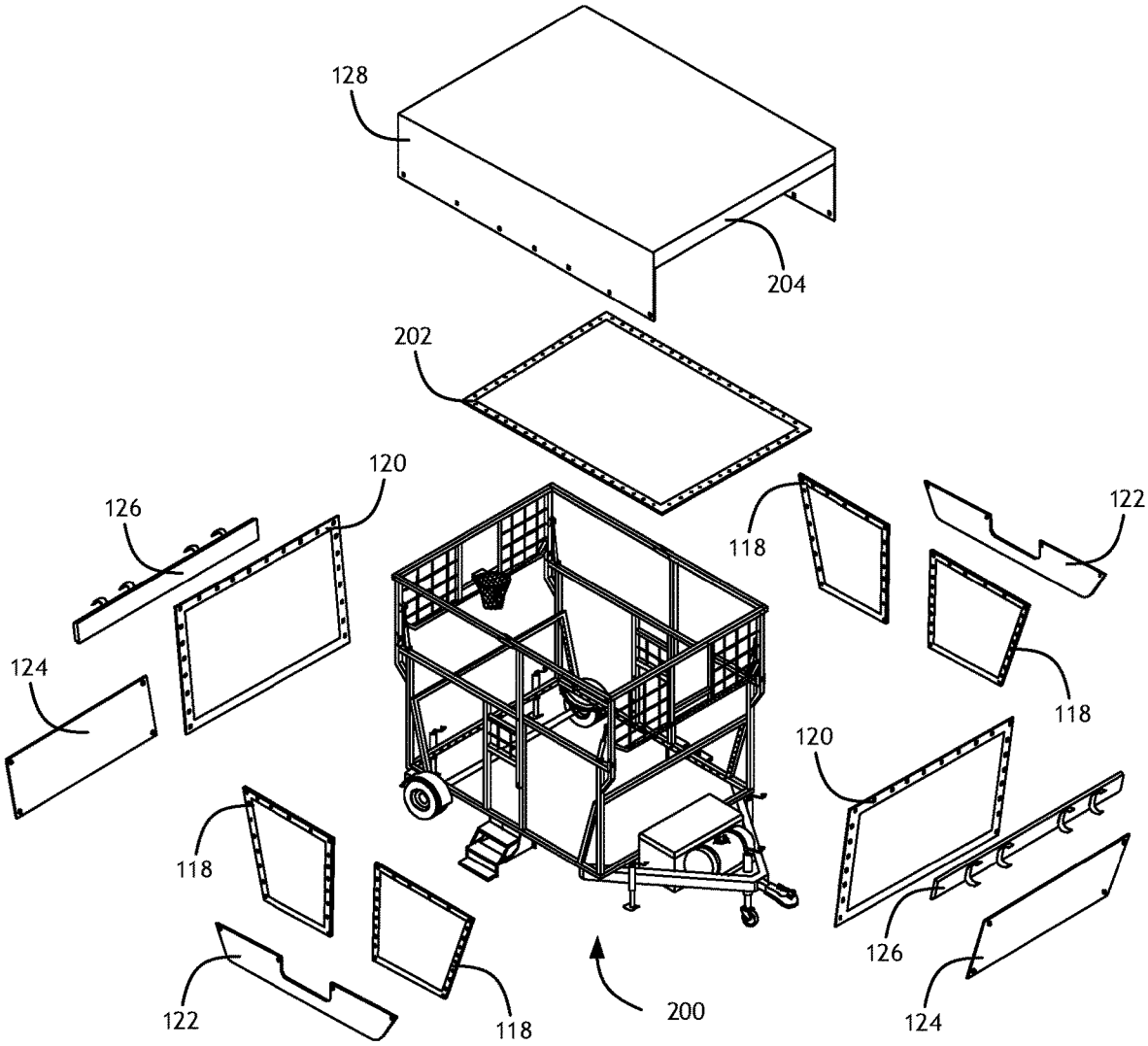
FIG. 2 shows an exploded perspective view of an exemplary embodiment of a mobile trampoline basketball device according to the inventive concepts disclosed herein.
Figure 3:
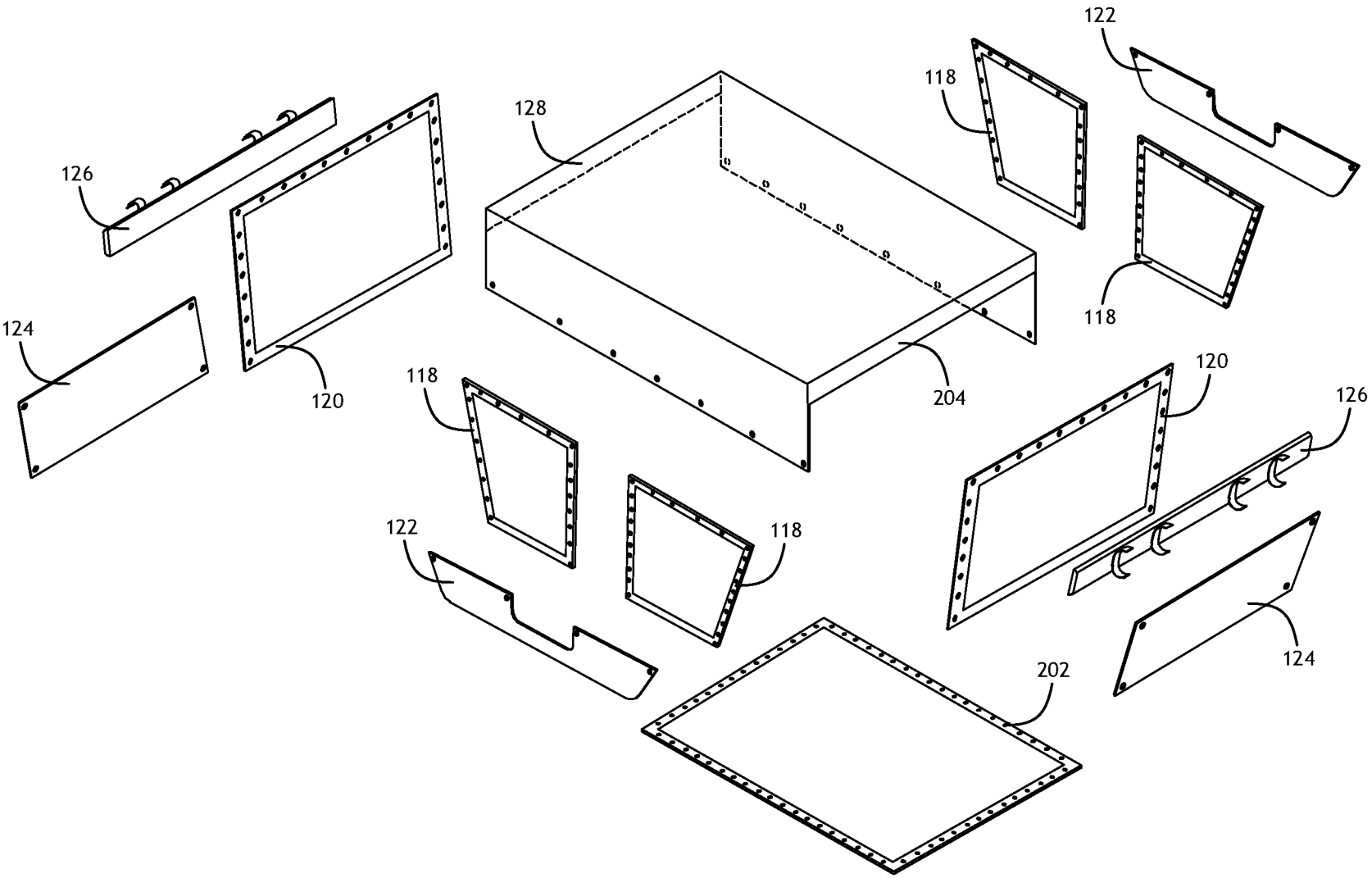
FIG. 3 shows an exploded perspective view of an exemplary embodiment of a mobile trampoline basketball device according to the inventive concepts disclosed herein.

Referring to FIGS. 2 and 3, exploded perspective views of an exemplary embodiment of a mobile trampoline basketball device according to the inventive concepts disclosed herein is shown. A mobile trampoline basketball device frame 200 is configured with a plurality of attach points, some configured for springs to connect the mobile trampoline basketball device frame 200 to the independent trampoline components 202 118, 120, and other attach points configured to attached the mobile trampoline basketball device frame 200 to the plurality of safety or environmental pads 122, 124, 126, 128.

In at least one embodiment, the mobile trampoline basketball device includes a bottom trampoline component 202 configured to connect via a plurality of springs to the perimeter elements of a base frame component, In at least one embodiment, base frame component is configured to accept a standard sized bottom trampoline component 202. Angled side trampoline components 120 are attached to the angled trampoline frame components along the sides and top, but not at any point along the bottom. The angled trampoline frame component is positioned and oriented such that the bottom of the angled side trampoline components 120 is disposed some distance from the springs attaching the bottom trampoline component 202 to the base frame component parallel to the bottom of the angled side trampoline component 120.

In at least one embodiment, the mobile trampoline basketball device includes a plurality of vertical side trampoline components 118 configured to connect via a plurality of springs to the angled trampoline frame component and a vertical door frame post of the mobile trampoline basketball device frame 200. In at least one embodiment, the vertical side trampoline components 118 are also connected to a top frame component of the mobile trampoline basketball device frame 200. The vertical side trampoline components 118 are may not be connected to the bottom frame component of the mobile trampoline basketball device frame 200.

In at least one embodiment, a plurality of side safety pads 122 are configured to connect to the mobile trampoline basketball device frame 200 at several points to prevent users from passing underneath the vertical side trampoline components 118 and impacting proximal frame components and entering or leaving the mobile trampoline basketball device except through defined entry points. The side safety pads 122 are disposed inside the mobile trampoline basketball device frame 200, and potentially between the mobile trampoline basketball device frame 200 and the corresponding vertical side trampoline components 118.

In at least one embodiment, a plurality of angled side safety pads 124 are configured to connect to the mobile trampoline basketball device frame 200 at several points to prevent users from passing underneath the angled side trampoline components 120 and impacting proximal frame components and entering or leaving the mobile trampoline basketball device except through defined entry points. The angled side safety pads 124 are disposed inside the mobile trampoline basketball device frame 200 but outside the angled trampoline frame components. Furthermore, an angled frame component pad 126 may be affixed to a top cross-bar of the angled trampoline frame component, disposed between the top cross-bar and a user inside the mobile trampoline basketball device.

In at least one embodiment, the mobile trampoline basketball device includes an environmental shield 128 such as a tarp configured to removably cover and connect to various portions of the top of the mobile trampoline basketball device frame 200. The environmental shield 128 protects the play surfaces and users from rain, excessive sun, and other environmental factors. In at least one embodiment, the environmental shield 128 may include lateral components 204 that each conform to a corresponding top cross-bar of a collapsible back-board component to prevent lateral movement of the environmental shield 128 and further protect the play surfaces and users from directional environmental factors.

Figure 4:
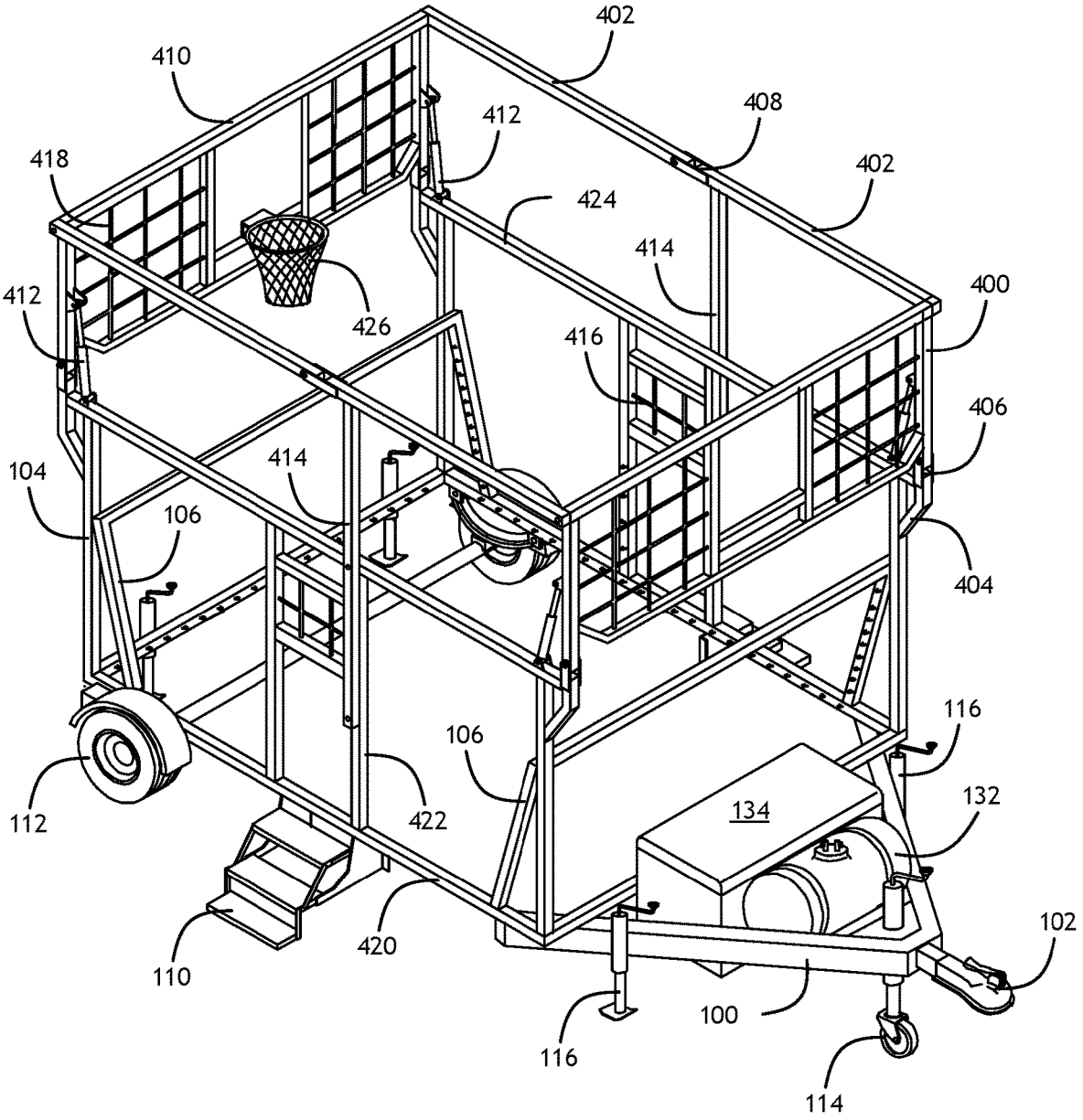
FIG. 4 shows a perspective view of an exemplary embodiment of a mobile trampoline basketball device frame according to the inventive concepts disclosed herein.
Figure 5:
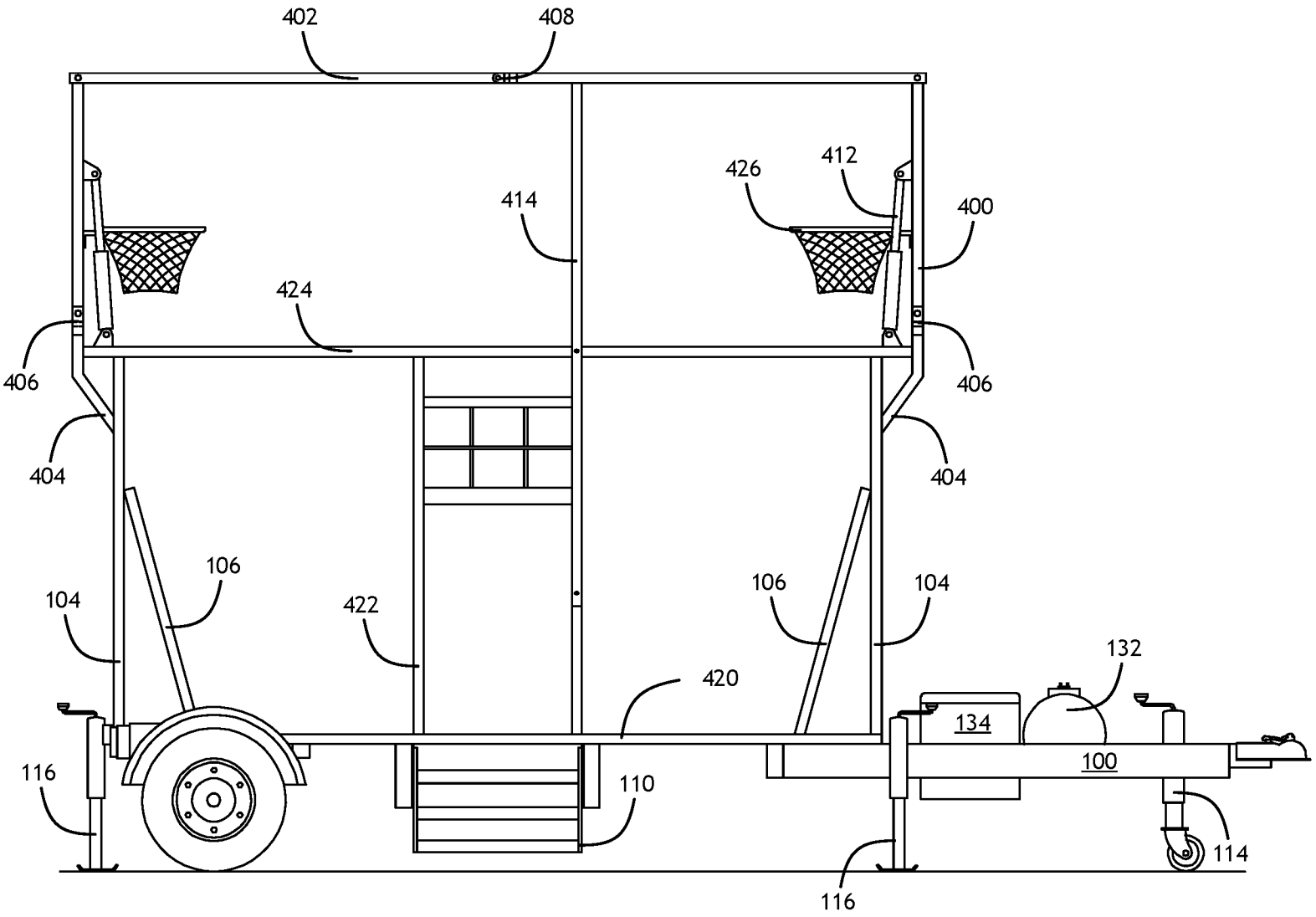
FIG. 5 shows a side view of an exemplary embodiment of a mobile trampoline basketball device frame according to the inventive concepts disclosed herein.
Figure 6:
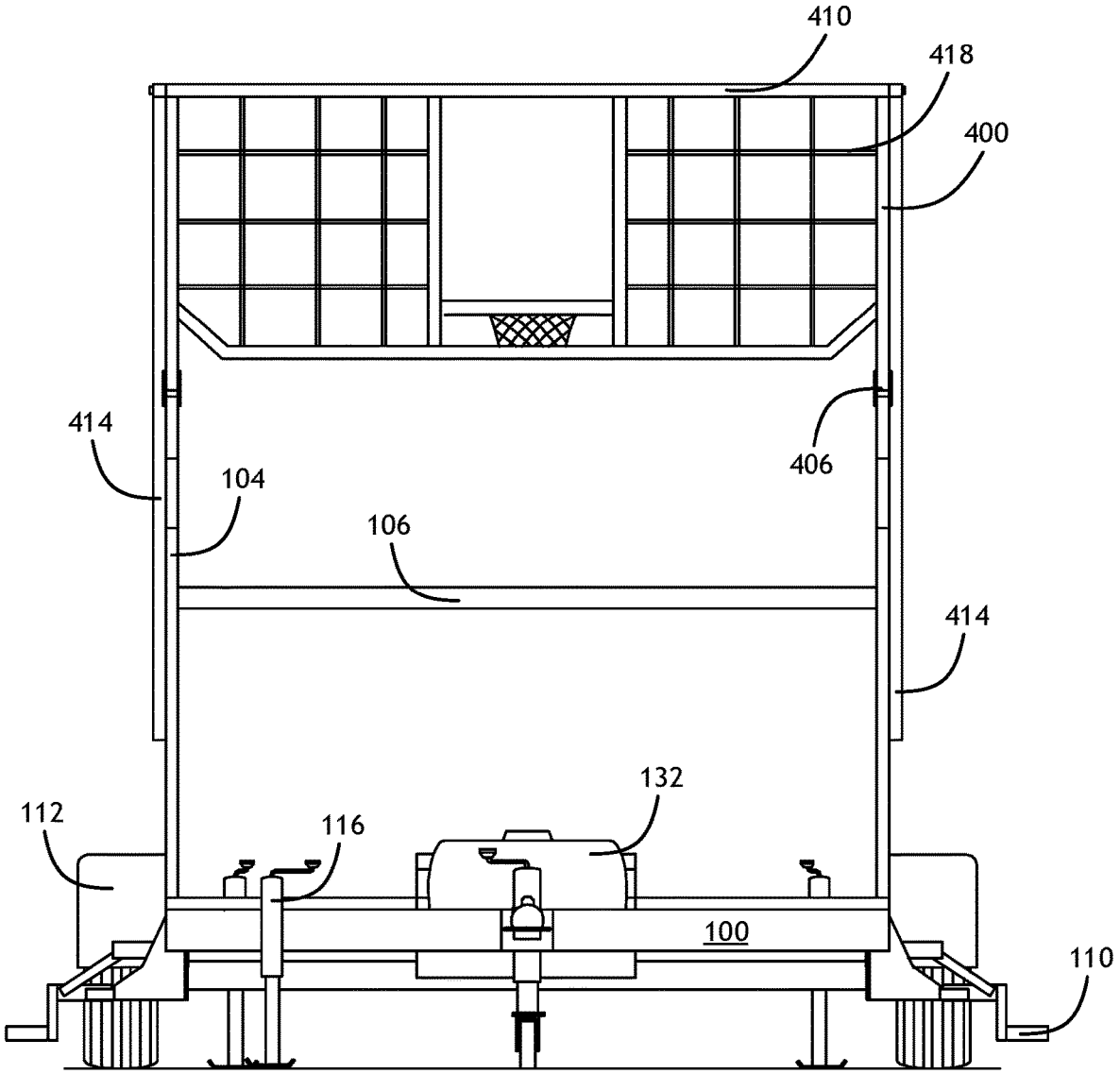
FIG. 6 shows a front view of an exemplary embodiment of a mobile trampoline basketball device frame according to the inventive concepts disclosed herein.

Referring to FIGS. 4, 5, and 6, a perspective view, a side view, and a front view of an exemplary embodiment of a mobile trampoline basketball device frame according to the inventive concepts disclosed herein are shown. The mobile trampoline basketball device frame includes a base frame component 420 connected to the trailer frame component 100 and wheeled component 112 for transport via attachment to a separate vehicle. Angled trampoline frame components 106 are connected to the base frame component 420 and vertical frame posts 104 such that corresponding angled side trampoline components create a backstop beneath a corresponding basketball hoop 426.

Because the wheeled component 112 is necessarily disposed beneath the base frame component 420, and the base frame component 420 supports a bottom trampoline component that substantially deforms when users are jumping on it, the angled trampoline frame components 106 should be attached to the base frame component 420 at least directly above the wheeled component 112, and potentially even further inside, to prevent a user from contacting the axel while jumping.

The base frame component 420 is connected to a plurality of door frame posts 422 that define the entry point and support corresponding top frame components 424. In at least one embodiment, the entry point defined by the plurality of door frame posts 422 may include a ventilation and lateral support structure 416 to stiffen the door frame posts 422 and facilitate air flow which may otherwise be restricted by the trampoline components and pads affixed to the mobile trampoline basketball device frame. ventilation and lateral support structure 416 may include a solid lattice or grate, a fabric mesh, or any other similar structure that allows airflow but prevents basketballs from exiting the device.

The mobile trampoline basketball device frame includes a collapsible frame component comprising two backboard structures, each having a two vertical backboard posts 400 connected to a backboard top cross-bar 410 to define the backboard surface. Each backboard structure is affixed to the top frame components 424 via a top frame hinge 406. In at least one embodiment, hinge support structures 404 are used to extend the top frame component 424 and push back the connection point to the backboard structure without substantially increasing the footprint of the device.

In at least one embodiment, each backboard structure is further connected to the top frame components 424 via one or more linear actuators 412 disposed between a vertical backboard post 400 and corresponding top frame component 424. Such linear actuators 412 may be hydraulic, pneumatic, electric, or mechanical, and serve to raise and lower the corresponding backboard into a vertical orientation for normal operation or horizontal orientation for transport. The top frame hinges 406 may be raised above the top frame component 424 to accommodate the operation of the linear actuators 412 and define an arc that allows the linear actuators 412 to lay flat against the top frame component 424 during transport.

Figure 7:
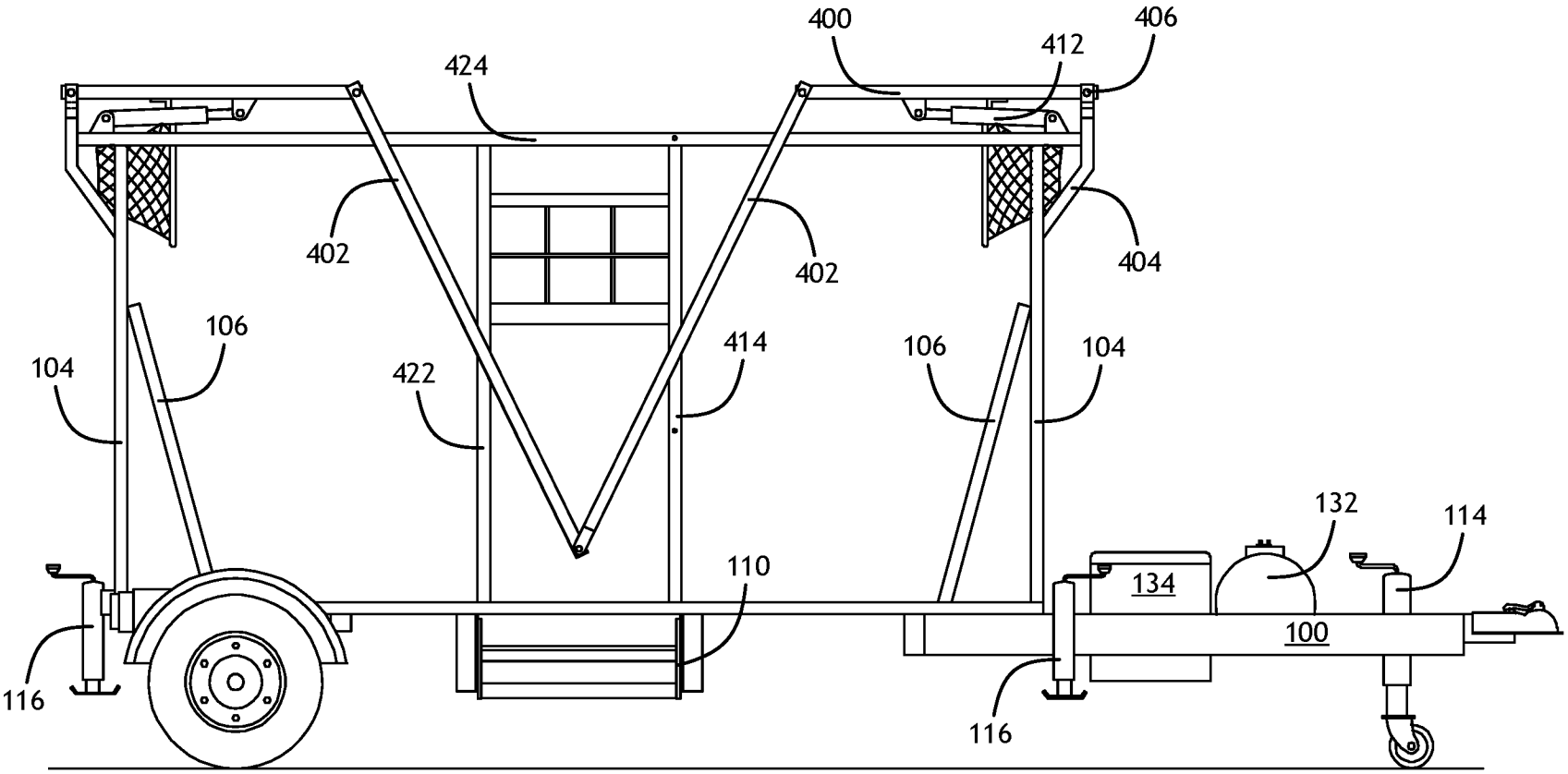
FIG. 7 shows a side view of an exemplary embodiment of a mobile trampoline basketball device frame according to the inventive concepts disclosed herein.
Figure 8:
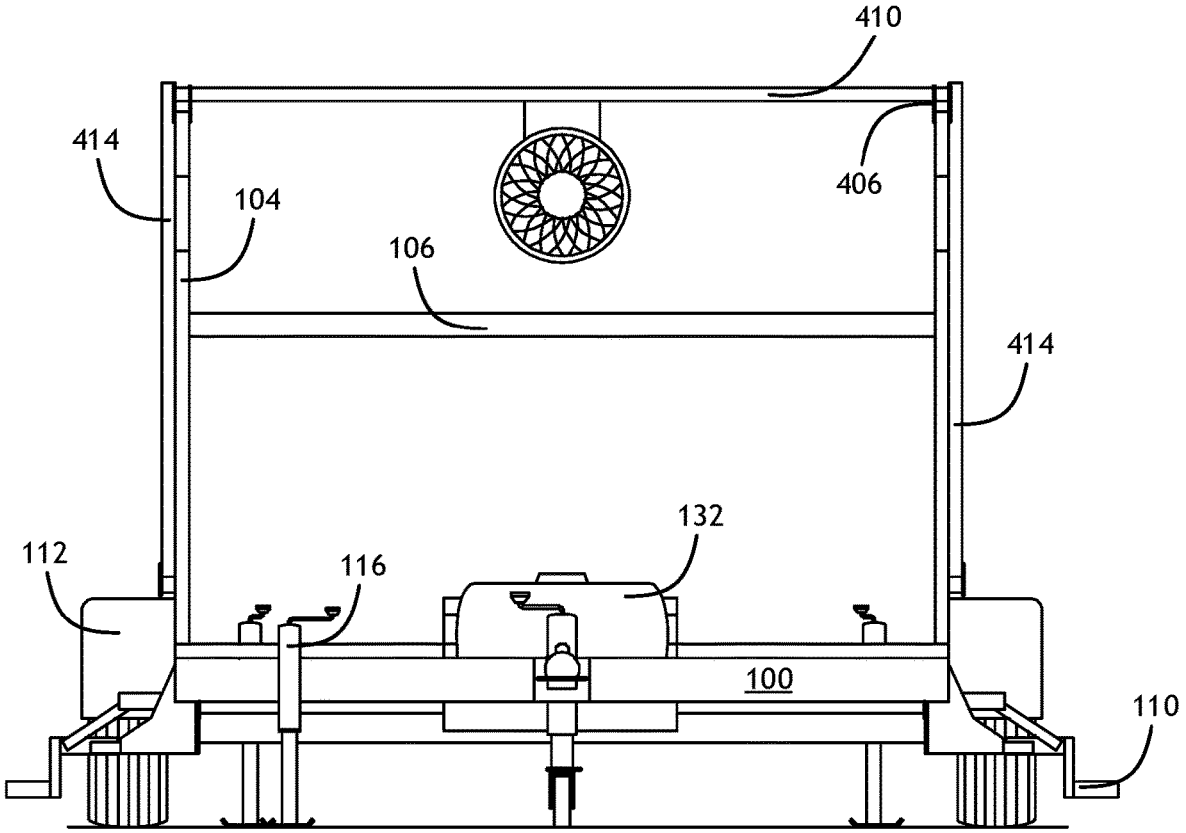
FIG. 8 shows a front view of an exemplary embodiment of a mobile trampoline basketball device frame according to the inventive concepts disclosed herein.

In at least one embodiment, the collapsible frame component includes a plurality of lateral support members 402. Each lateral support member 402 may be pivotally connected to a corresponding backboard via either the backboard to cross-bar 410 or a vertical backboard post 400. Furthermore, opposing lateral support members 402 (lateral support members 402 connected to opposite backboards) may be connected to each other via a lateral support member hinge 408 that allows each opposing lateral support member 402 to fold down for transport as illustrated in FIGS. 7 and 8. In at least one embodiment, a lateral support post 414 may secure the lateral support member hinge 408 in a fully extended orientation, as shown in FIGS. 4 and 5, by supporting a lateral support member 402. The lateral support post 414 may be releasably secured to a corresponding door frame post 422.

In at least one embodiment, each backboard may define a ventilation structure 418 to facilitate air flow which may otherwise be restricted by the trampoline components and pads affixed to the mobile trampoline basketball device frame. The ventilation structure 418 may include a solid lattice or grate, a fabric mesh, or any other similar structure that allows airflow but prevents basketballs from exiting the device. Having the ventilation structures 418 defined by the backboard necessarily places them at the top of the device which facilitates a draft by letting warmer air exit at the top and drawing in cooler air through gaps defined by the springs that secure the bottom trampoline component to the base frame component 420.

Referring to FIGS. 7 and 8, a side view and a front view of an exemplary embodiment of a mobile trampoline basketball device frame according to the inventive concepts disclosed herein are shown. In a configuration for transport, the collapsible stairs 110 are folded up and the jacks 116 retracted. Furthermore, the linear actuators 412 are also retracted to pivot the backboard structures about their corresponding top frame hinges 406 such that the vertical backboard posts 400 are oriented substantially parallel to the top frame components 424. Removing or retracting the lateral support posts 414 allows the lateral support members 402 to pivot about their respective connection points to the backboard structure, and a hinge connecting opposing lateral support members 402. In at least one embodiment, the lateral support members 402, when in a transport configuration, obstruct the entry point defined by the door frame posts 422 to prevent or deter entry during transport, or alternatively retain anything inside the mobile trampoline basketball device frame during transport.

Figure 9:
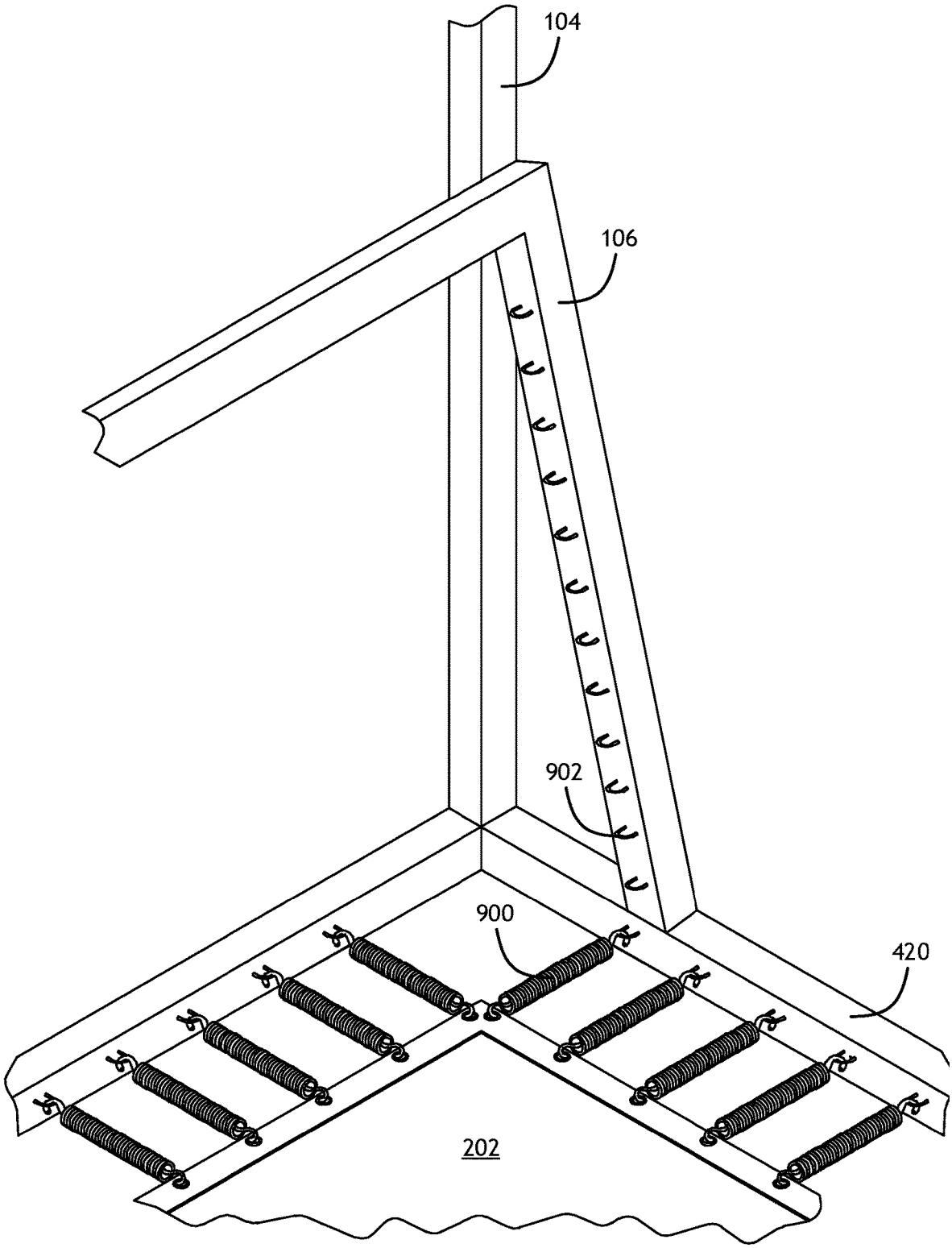
FIG. 9 shows a partial perspective view of an exemplary embodiment of a mobile trampoline basketball device frame according to the inventive concepts disclosed herein.

Referring to FIG. 9, a partial perspective view of an exemplary embodiment of a mobile trampoline basketball device frame according to the inventive concepts disclosed herein is shown. Where the base frame component 420, vertical frame posts 104, and angled trampoline frame components 106 meet, the angled trampoline frame components 106 may be connected to the base frame component 420 so as to obstruct the springs 900 connecting the bottom trampoline component 202 to the base frame component 402 that are disposed behind an angled side trampoline component attached to the angled trampoline frame component 106 via a plurality of spring attachment points 902. While springs 900 have been specifically mentioned herein, other structures are used in trampolines, and such other structures are envisioned.

It is believed that the inventive concepts disclosed herein and many of their attendant advantages will be understood by the foregoing description of embodiments of the inventive concepts disclosed, and it will be apparent that various changes may be made in the form, construction, and arrangement of the components thereof without departing from the broad scope of the inventive concepts disclosed herein or without sacrificing all of their material advantages; and individual features from various embodiments may be combined to arrive at other embodiments. The form herein before described being merely an explanatory embodiment thereof, it is the intention of the following claims to encompass and include such changes. Furthermore, any of the features disclosed in relation to any of the individual embodiments may be incorporated into any other embodiment.

What is claimed is:

1. A game apparatus comprising:

a frame comprising:

a base frame component configured to support a trampoline surface;

a plurality of lower vertical frame posts connected to the base frame component;

at least two top frame components, each of the at least two top frame components connected to and extending past two of the lower vertical frame posts, and each pivotably connecting two upper vertical frame posts to the corresponding top frame component at a portion extending past the lower vertical frame posts;

a plurality of hinge support structures, each hinge support structure extending the top frame components, and configured to push back a connection point to the backboard structure without substantially increasing a footprint of the base frame component;

a plurality of hinges, each connecting a hinge support structure to a upper vertical frame post;

at least two angled trampoline frame components, each configured to support an angled side trampoline component, each connected to the base frame component and the at least two lower vertical frame posts;

a collapsible top frame component comprising:

two backboard structures pivotably connected to the at least two top frame components; and at least two linear actuators connecting the backboard structures to the top frame components;

a plurality of lateral support members, each pivotably connected to one of two backboards at a proximal end and connected via a hinge to another lateral support member at a distal end;

a plurality of lateral support posts, each lateral support post configured to:

maintain at least one of the plurality of lateral support members connected via the hinge in a linear orientation, and configured to be releasably secured to a corresponding door frame in a deployed configuration;

wherein the lateral support members connected via the hinge are disposed to obstruct an entry point defined by two door frame posts when in a transport configuration;

at least one wheeled component connected to the base frame component; and a trailer frame component with a trailer coupler, wherein:

at least one of the at least two angled trampoline components is connected to the base frame component at a location to prevent a user from contacting any portion of the at least one wheeled component when jumping on a trampoline surface supported by the base frame component; and the at least two linear actuators are configured to transition the two backboards between a playable configuration where the two backboards are vertical and a transport configuration where the two backboards are horizontal.

2. The game apparatus of claim 1, further comprising a plurality of jacks disposed on the base frame component, the plurality of jacks configured to level the base frame component.

3. The game apparatus of claim 1, further comprising an environmental shield configured to cover a top opening defined by the two backboards and the lateral support members and connect to the at least two top frame components.

4. The game apparatus of claim 3, wherein the two backboards each define one or more ventilation structures configured to facilitate airflow.

5. A game apparatus comprising:

a frame comprising:

a base frame component configured to support a trampoline surface;

a plurality of lower vertical frame posts connected to the base frame component;

at least two top frame components, each of the at least two top frame components connected to and extending past two of the lower vertical frame posts, and each pivotably connecting two upper vertical frame posts to the corresponding top frame component at a portion extending past the lower vertical frame posts;

a plurality of hinge support structures, each hinge support structure extending the top frame components, and configured to push back a connection point to the backboard structure without substantially increasing a footprint of the base frame;

a plurality of hinges, each connecting a hinge support structure to a upper vertical frame post;

at least two angled trampoline frame components, each configured to support an angled side trampoline component, each connected to the base frame component and the at least two lower vertical frame posts;

a collapsible top frame component comprising:

two backboard structures pivotably connected to the at least two top frame components;

a plurality of lateral support members, each pivotably connected to a backboard at a proximal end and connected via a hinge to another lateral support member at a distal end; and at least two linear actuators connecting the backboard structures to the top frame components;

a plurality of lateral support members, each pivotably connected to one of two backboards at a proximal end and connected via a hinge to another lateral support member at a distal end;

a plurality of lateral support posts, each lateral support post configured to:

maintain at least one of the plurality of lateral support members connected via the hinge in a linear orientation, and configured to be releasably secured to a corresponding door frame in a deployed configuration;

wherein the lateral support members connected via the hinge are disposed to obstruct an entry point defined by two door frame posts when in a transport configuration;

at least one wheeled component connected to the base frame component; and a trailer frame component with a trailer coupler, wherein:

at least one of the at least two angled trampoline components is connected to the base frame component at a location to prevent a user from contacting any portion of the at least one wheeled component when jumping on a trampoline surface supported by the base frame component; and the at least two linear actuators are configured to transition the two backboards between a playable configuration where the two backboards are vertical and a transport configuration where the two backboards are horizontal.

6. The game apparatus of claim 5, further comprising a plurality of jacks disposed on the base frame component, the plurality of jacks configured to level the base frame component.

7. The game apparatus of claim 5, further comprising an environmental shield configured to cover a top opening defined by the two backboards and the lateral support members and connect to the at least two top frame components.

8. The game apparatus of claim 7, wherein the two backboards each define one or more ventilation structures configured to facilitate airflow.

9. The game apparatus of claim 5, further comprising at least one collapsible stair case.

* * * * *